United States Patent [19]

Thettu et al.

[11] 4,013,400

[45] Mar. 22, 1977

[54] CLEANING APPARATUS FOR A HEAT AND PRESSURE FUSER

[75] Inventors: Raghulinga R. Thettu, Webster; Michael J. Oszczakiewicz, Penfield, both of N.J.

[73] Assignee: Xerox Corporation, Stamford, Conn.

[22] Filed: July 21, 1975

[21] Appl. No.: 597,734

[52] U.S. Cl. ..... 432/75; 118/104

[51] Int. Cl.[2] ..... F27D 23/00

[58] Field of Search ..... 118/60, 203, 104, 257; 432/8, 59, 60, 228, 75; 15/256.52

[56] References Cited

UNITED STATES PATENTS

| | | | |
|---|---|---|---|
| 3,716,221 | 2/1973 | Gorka et al. | 118/60 |
| 3,811,821 | 5/1974 | Ariyama et al. | 118/60 X |
| 3,929,095 | 12/1975 | Thettu | 118/60 |

*Primary Examiner*—Dorsey Newton

[57] ABSTRACT

A contact fuser assembly for use in electrostatic reproducing apparatus including a heated fuser roll structure cooperating with a backup roll to form a nip through which copy sheets having toner images thereon move with the toner images contacting the heated fuser roll structure. The fuser assembly is characterized by the provision of a cleaning arrangement comprising a roll having a tacky surface which is adapted to contact the fuser roll structure to thereby remove contaminants therefrom. The cleaning arrangement is further characterized by the provision of means for rejuvenating the tacky surface of the cleaning roll wherein polymer material is applied to the cleaning roll and is tacky at the operating temperature of the fuser apparatus.

6 Claims, 2 Drawing Figures

CLEANING APPARATUS FOR A HEAT AND PRESSURE FUSER

BACKGROUND OF THE INVENTION

This invention relates generally to xerographic copying apparatus and, more particularly, to a contact fusing system and cleaning mechanism therefor for fixing electroscopic toner material to a support member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photosensitive member or transferred from the member to a sheet of plain paper with subsequent affixing of the image thereto.

In order to permanently affix or fuse electroscopic toner material onto a support member by heat, it is necessary to elevate the temperature of the toner material to a point at which the constituents of the toner material coalesce and become tacky. This action causes the toner to be absorbed to some extent into the fibers of the support member which, in many instances, constitutes plain paper. Thereafter, as the toner material cools, solidification of the toner material occurs causing the toner material to be firmly bonded to the support member. In both xerographic as well as the electrographic recording arts, the use of thermal energy for fixing toner images onto a support member is old and well known.

One approach to thermal fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the heated roll to thereby effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner would liquify and cause a splitting action in the molten toner to thereby result in "hot offset". Splitting occurs when the cohesive forces holding the viscous toner mass together are less than the adhesive forces tending to offset it to a contacting surface such as a fuser roll.

However, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the problems attendant the foregoing, particularly that which is commonly referred to as "offsetting" has been to provide a fuser roll with an outer surface or covering of polytetrafluoroethylene, commonly known as Teflon, to which a release agent such as silicone oil is applied, the thickness of the Teflon being on the order of several mils and the thickness of the oil being less than 1 micron. Silicone based oils, which possess a relatively low surface energy, have been found to be materials that are suitable for use in the heated fuser roll environment where Teflon constitutes the outer surface of the fuser roll. In practice, a thin layer of silaicone oil is applied to the surface of the heated roll to thereby form an interface between the roll surface and the toner images carried on the support material. Thus a low surface energy layer is presented to the toner as it passes through the fuser nip and thereby prevents toner from offsetting to the fuser roll surface. The foregoing notwithstanding, "non-visual offsetting" (i.e. offsetting of very fine particles of toner) does occur. In prior art constructions (fuser structures where the outer surface comprises Teflon or silicone rubber) such offsetting has been combated by the employment of various cleaning members, the wick material employed for applying the silicone based oil to the fuser roll serving this purpose.

Other fuser roll cleaning construction comprise a cleaning member having a surface which is tacky at the operating temperature of the fuser roll. Such tackiness is usually provided by having a coating of polymer material comprising the outer layer or coating of the cleaning member. While such a cleaning member has been found to be acceptable for its intended purposes it has been found that during certain modes of operation of the copying apparatus that the cleaning efficiency of such a member can be adversely affected.

Accordingly, the primary object of this invention is to provide a new and improved contact fuser system for fixing toner images to substrates.

A more particular object of this invention is to provide, in a contact fuser system, means for cleaning the heated fuser member of the contact fuser assembly.

Another object of this invention is to provide, in a contact fusing apparatus, structure for cleaning contaminants from a heated member of the fusing apparatus wherein the cleaning structure has a tacky surface capable of being rejuvenated.

Still another object of this invention is to provide, in a fuser apparatus, apparatus and a method for cleaning a heated fuser member wherein the tacky surface of the cleaning member is periodically rejuvenated to thereby enhance the life of such a member.

Yet another object of this invention is to provide a cleaning structure comprising an outer layer of silicone rubber which is incompletely cured in order to provide a tacky-surfaced cleaning structure.

A further object of this invention is the method of rendering a cleaning surface tacky.

BRIEF SUMMARY OF THE INVENTION

Briefly, the above-cited objects are accomplished by the provision of a roll fuser apparatus comprising a heated fuser roll structure cooperating with a resilient backup roll member to form a nip through which copy sheets having toner images thereon move with the toner images contacting the heated fuser roll structure.

A cleaning roll having a tacky surface is supported for contacting the fuser roll structure in order to remove the contaminants such as toner and paper fiber therefrom.

The tacky surface is provided by incompletely curing a silicone rubber layer forming the outer surface of the aforementioned cleaning roll. In order to extend the life of the tacky surface cleaning roll, there is provided means for applying a coating of polymer material to the surface of the cleaning roll on a periodic basis.

In the preferred embodiment of the invention the coating of polymer material which is tacky at the operating temperature of the fuser apparatus is provided a web having a layer of the polymer material thereon and which is held in contact with the cleaning roll for a predetermined period of time. Transport means is provided for intermittently moving the web in order that a fresh supply of polymer material can be periodically presented to the cleaning roll. By the provision of such a web, the removal of contaminants from the fuser roll structure can be accomplished by directly contacting the fuser roll structure without the need for the coating of an intermediate member such as the aforementioned cleaning roll.

Other objects and advantages of the present invention will become apparent when read in conjunction with the accompanying drawings.

DETAILED DESCRIPTION OF THE PREFERRED EMBODIMENT

Since the xerographic reproducing process is well known, a detailed description thereof is omitted. For those who would consider a description of the xerographic process necessary for a complete understanding of the present invention, reference may be had to U.S. Pat. Nos. 3,718,116 and 3,745,972 which patents are incorporated herein by reference.

Figure 1:
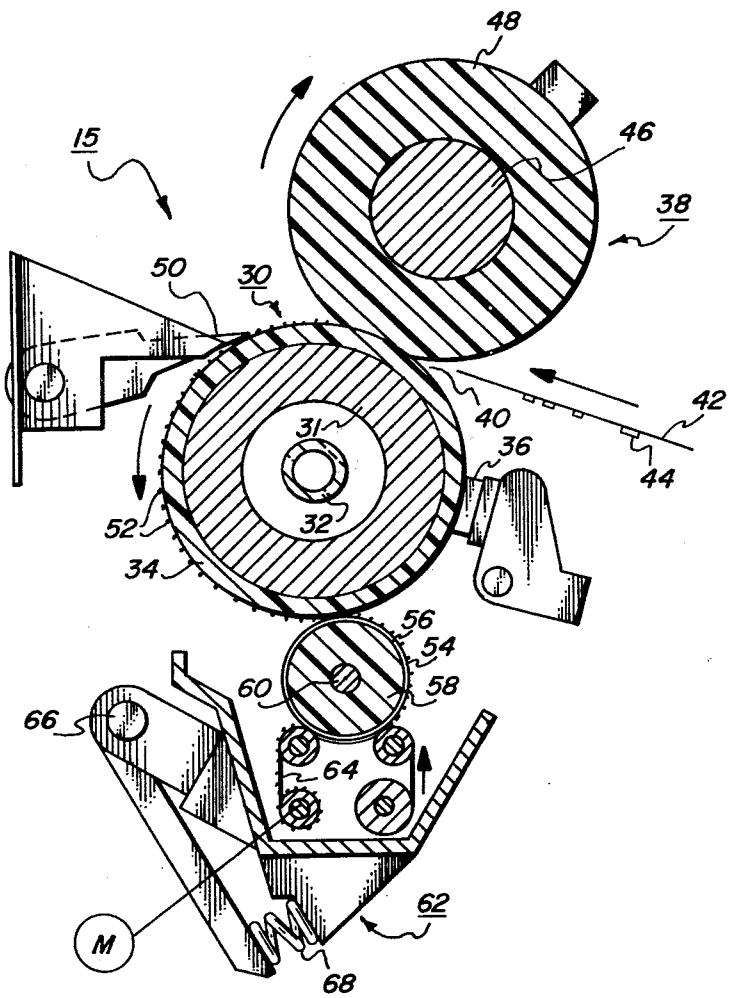
FIG. 1 is a side elevational view of a contact fuser apparatus incorporating the novel cleaning device.

As shown in FIG. 1, the present invention comprises a fuser roll assembly 15 including a heated roll structure 30 including a hollow cylinder or core 31 having a suitable heating element 32 disposed in the hollow portion thereof and which is coextensive with the longitudinal axis of said cylinder or core. The core 31 has provided on the outer surface thereof a layer of silicone rubber 34 or other suitable material which has abhesive characteristics, therefore, tendency to release toner type contaminants therefrom. The heating element 32 may comprise a suitable type heater for elevating the surface of the silicone rubber layer to operational temperatures, therefore, temperatures on the order of 250–450 F. For example, the heating element may comprise a quartz lamp. The cylinder or core 31 is fabricated from any themally conductive material, for example, steel, aluminum, or alloys thereof. The resulting structure has an outside diameter on the order of 1.5 to 3.0 inches and a length on the order of 10 to 15 inches. Power requirements for the foregoing are 500–2500 watts, peak power with an average power 300–2000 watts and 75–250 watts for standby.

The surface temperature of the fuser roll structure is controlled by contacting the surface thereof with a thermistor probe 36 in a manner described in U.S. Pat. No. 3,327,096, issued in 1967 to Bernous and incorporated herein by reference. To this end, the end of the roll contacted by the thermistor probe 36 may be specifically designed to accommodate such control of the operating temperature. In other words, means may be provided to reduce friction between the probe 36 and the surface of the fuser roll structure. One method of accomplishing the foregoing would be to manufacture the fuser roll structure 30 such that the end thereof contacted by the probe 36 is devoid of silicone rubber material whereby the probe contacts the core and the set point of the thermistor is adjusted accordingly.

The fuser assembly 15 further comprises a backup roll structure 38 which cooperates with the fuser roll structure to form a nip 40 through which copy paper or substrate material 42 passes such that toner images 44 thereon contact the surface of the fuser roll structure 30. The backup roll structure may comprise any suitable construction for example, a steel cylinder, but preferably comprises a rigid steel core 46 having a Viton elastomer surface or layer 48 which as can be observed has a relatively large thickness in order to provide a soft member which can be indented by the fuser roll structure 30 in order to form the nip 40.

After the copy sheet or substrate material 42 passes through the nip 40 it tends to stick or adhere to the surface of the fuser roll structure 30. Accordingly, stripper finger structure 50 is provided for stripping the copy sheet or substrate material from the surface of the fuser roll structure 30 so that the copy sheets can continue on their intended path of movement toward the exit of the copier apparatus.

As noted hereinbefore, as the copy sheets 42 pass through the nip 40 in contact with the surface of the fuser roll structure 30 and the backup roll structure 38 contaminants are offset onto the surface of the fuser roll structure 30. Because the surface of the fuser roll structure 30 comprises the aforementioned silicone rubber which constitutes an abhesive material, the contaminants can be readily removed from the fuser roll structure 30. Also noted above was the fact that tacky surfaced cleaning rolls such as cleaning roll structure 54 shown in its operative position (i.e. engaged with the fuser roll structure 30) for removing contaminants for removing contaminants such as toner and paper fiber from fuser roll structures are well known. In its inoperative position the roll structure 54 is moved out of engagement from the fuser roll structure. One form of such a cleaning roll structure comprises a sleeve carried by a core member which is, in turn, rotatingly supported by means of a shaft, the ends of which are supported by end plates (not shown) of a support mechanism 62. A cleaning structure of this type is disclosed in U.S. Pat. No. 3,861,860 issued in the name of Thettu and incorporated herein by reference. As described in the foregoing patent, the sleeve is provided with a polymer material which is tacky at the operating temperature of the fuser roll structure. The polymer material preferably comprises a material selected from the group of aliphatic, aromatic or mixtures of aliphatic, aromatic polyesters which have a melting or softening point ranging from about 120° C. to about 275° C. Consequently, the polymer provides an effective mechanism for removing the contaminants 52 from the surface of the fuser roll structure 30.

As contemplated by the present invention, the method of providing a tacky-surfaced cleaning structure and the structure differs from the foregoing, in that, a cleaning roll structure 54 itself comprises a base layer 58 of silicone rubber having an outer layer 56 of RTV material, for example, G. E. 112. The outer layer 56 comprises a tacky layer resulting from the incomplete curing of the silicone rubber, the degree of tackiness being controlled by controlling the relative humidity during the curing of the silicone rubber. For example, it has been found that if the relative humidity is 80% and above, the desired tackiness is achieved. It has also been found that the addition of 5% by weight into the layer 56 of certain materials will produce the desired results. For example, the addition of Thermolite-12 (Trademark of M & T Chemicals, Inc. for a series of stabilizers for vinyl resins) produces the desired tackiness.

It will be appreciated that the thickness of the outer layer 56 will, in time, become overly contaiminated to the point that the cleaning roll structure 54 loses its efficiency in removal of contaminants from the fuser roll structure 30.

In order to extend the life of the cleaning roll structure and thereby eliminate the need for replacing of the cleaning roll structure there is provided a support structure 62 for supporting a web 64 carrying polymer material in engagement with the cleaning roll structure 54 to thereby coat the cleaning roll structure 54 with tacky polymer material to thereby rejuvenate the surface of the cleaning roll structure 54. The web may comprise 0.004–0.005 thick Nomex material having a 0.002–0.003 thick layer of polymer material thereon. The support structure 62 is pivotally supported as indicated at 66 and can therefore be pivoted clockwise to remove the web from engagement with the cleaning roll structure 54 and then in a counterclockwise direction to effect engagement therebetween. A spring 68 provides a simple bias means for maintaining proper engagement of the web with the cleaning roll structure 54. Typical materials employed for utilization as the tacky polymer comprise a copolymerized mixture of styrene or a blend of styrene homologs with 10 to 40% of one or more methrycalate esters selected from the group consisting of ethyl, propyl, and butyl methrycalate, as described in U.S. Pat. No. 3,079,342 and incorporated herein by reference. The foregoing copolymerized mixture also comprises between 5 and 15% by weight of polyvinyl butyral and preferably 5%.

Figure 2:
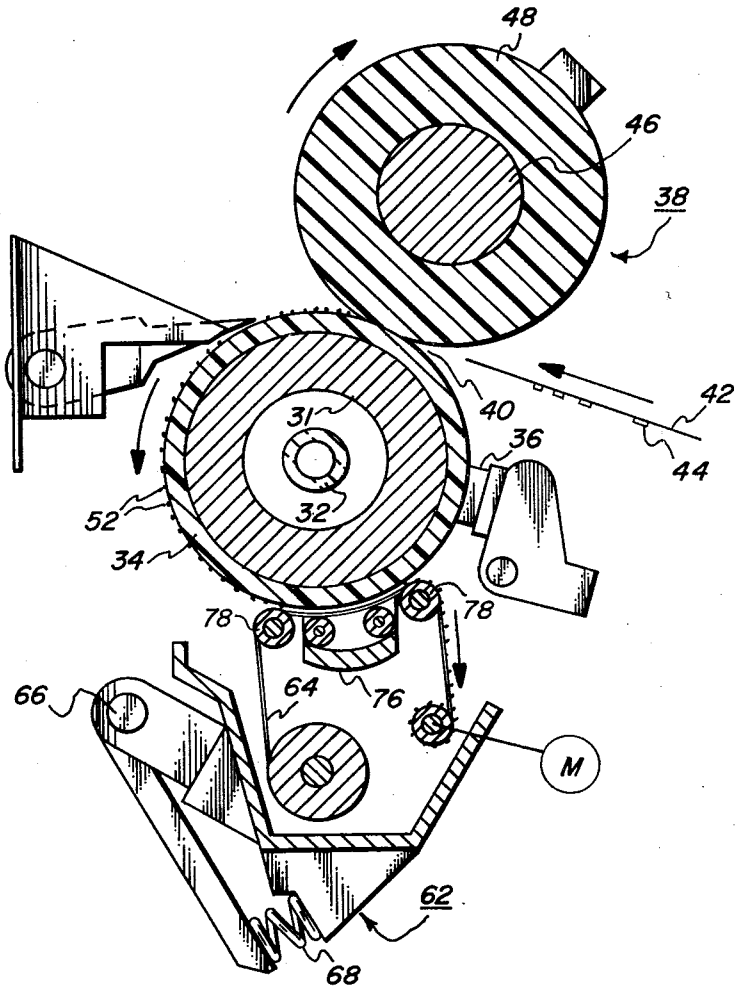
FIG. 2 is a side elevational view of a fuser apparatus incorporating a modified form of the cleaning structure disclosed in FIG. 1.

A modified form of the invention as illustrated in FIG. 2 dispenses with the cleaning roll structure 54 and utilizes the web directly for removing contaminants from the fuser roll structure. In this embodiment there is provided a cooling arrangement 76 which may employ any conventional means such as heat pipes disposed internally thereof and thereof a pair of roll members 78 which hold the web 64 against the fuser roll structure 34. Alternatively, the cooling may be provided by a stationary platen containing conventional heat pipes for maintaining the temperature of the polymer material at a level conductive in retaining the polymer in a tacky state. A motor M is provided in each of the embodiments of FIGS. 1 and 2 for moving the webs 64 to provide a fresh area thereof.

While the invention has been disclosed in accordance with the embodiments presently contemplated, it will be understood that various modifications thereto may be made by those skilled in the art without departing from the spirit of the present invention.

What is claimed is:

1. Fuser apparatus for fixing toner images to support material, said apparatus comprising:

a pair of nip-forming members between which said support material moves with said toner images contacting a heated one of said nip-forming members;

means for elevating the surface temperature of said heated member to thereby render said toner images tacky;

a cleaning member having a tacky surface, said cleaning member being positioned to contact the surface of said heated one of said nip-forming members;

an elongated member having a coating of tackifiable material thereon;

means for stationarily supporting said elongated member in contact with said cleaning member to thereby transfer tackifiable material to said cleaning member whereby said tacky surface becomes rejuvenated; and means for effecting movement of said elongated member whereby different portions thereof are brought into contact with said tacky surface at periodic intervals.

2. Apparatus according to claim 1 wherein said elongated member comprises an elongated web

3. Apparatus according to claim 2 wherein said coating of tackifiable material comprises a polymer material having a melting point on the order of 120° C. to about 275° C.

4. Apparatus according to claim 2 wherein said cleaning member comprises a silicone rubber roll wherein the silicone rubber is incompletely cured to thereby provide said tacky surface.

5. Apparatus according to claim 2 wherein said polymer comprises an aromatic polyester.

6. Apparatus according to claim 5 wherein said heated one of said nip-forming members and said cleaning member comprise roll structure.

* * * * *